US010660415B1

(12) United States Patent
Li

(10) Patent No.: US 10,660,415 B1
(45) Date of Patent: May 26, 2020

(54) UMBRELLA FRAME STRUCTURE FOR TWO-FOLD INVERTED UMBRELLA

(71) Applicant: Sheng-Chun Li, Taoyuan (TW)

(72) Inventor: Sheng-Chun Li, Taoyuan (TW)

( * ) Notice: Subject to any disclaimer, the term of this patent is extended or adjusted under 35 U.S.C. 154(b) by 0 days.

(21) Appl. No.: 16/243,962

(22) Filed: Jan. 9, 2019

(30) Foreign Application Priority Data

Nov. 7, 2018 (TW) ..... 107139493 A

(51) Int. Cl.

| | |
|---|---|
| ***A45B 19/10*** | (2006.01) |
| ***A45B 25/02*** | (2006.01) |
| ***A45B 25/06*** | (2006.01) |
| *A45B 19/00* | (2006.01) |

(52) U.S. Cl.
CPC ..... *A45B 19/10* (2013.01); *A45B 25/02* (2013.01); *A45B 25/06* (2013.01); *A45B 2019/008* (2013.01)

(58) Field of Classification Search
CPC ..... A45B 19/10; A45B 25/02; A45B 25/22; A45B 25/06; A45B 2019/008
USPC ..... 135/28, 31
See application file for complete search history.

(56) References Cited

U.S. PATENT DOCUMENTS

| | | | | |
|---|---|---|---|---|
| 579,185 | A * | 3/1897 | Shaine | A45B 19/04 135/25.1 |
| 4,834,126 | A * | 5/1989 | Sweet, Jr. | A45B 25/02 135/15.1 |
| 5,794,637 | A * | 8/1998 | Figueroa | A45B 25/22 135/27 |
| 6,006,770 | A * | 12/1999 | Lin | A45B 25/02 135/29 |
| 9,486,044 | B1 * | 11/2016 | Dai | A45B 25/22 |
| 10,244,836 | B2 * | 4/2019 | Liu | A45B 19/10 |
| 2004/0211451 | A1 * | 10/2004 | Goh | A45B 25/20 135/31 |
| 2006/0124160 | A1 * | 6/2006 | Lee | A45B 25/02 135/28 |
| 2019/0069654 | A1 * | 3/2019 | Chen | A45B 25/22 |

* cited by examiner

*Primary Examiner* — David R Dunn
*Assistant Examiner* — Danielle Jackson

(57) ABSTRACT

An umbrella frame structure for two-fold inverted umbrella includes an umbrella shaft assembly, and a plurality of rib assemblies each including a main rib, a sub rib, a stretcher and a tip that connects one end of the main rib and one end of the sub rib. The stretcher has one end thereof connected to a part of the main rib between the two opposite ends of the main rib, and an opposite end thereof disposed in one respective positioning groove of a lower nest of the umbrella shaft assembly and pivotally connected with an opposite end of the sub rib in the respective positioning groove. The main rib has an opposite end thereof pivotally connected to an upper nest of the umbrella shaft assembly.

3 Claims, 6 Drawing Sheets

UMBRELLA FRAME STRUCTURE FOR TWO-FOLD INVERTED UMBRELLA

BACKGROUND OF THE INVENTION

1. Field of the Invention

The present invention relates to umbrella technology and more particularly, to an umbrella frame structure for two-fold inverted umbrella, which facilitates installation.

2. Description of the Related Art

In a conventional inverted umbrella, an air medium is formed between an outer cloth and inner cloth of the umbrella cloth to block the sunlight, and the inner cloth is provided with vent holes for heat dissipation. Referring to FIG. 1, for the connection of the inner cloth A and the outer cloth B, the rib set C of the umbrella frame is designed to provide main ribs C1, sub ribs C2 and stretchers C3, and the lower nest D2 of the nest set D is configured to provide two sets of pivot connection grooves D21 at the opposing top and bottom sides, thus, the main ribs C1 can be respectively and pivotally connected to the respective pivot connection grooves D11 of the upper nest D1 of the nest set D, and the sub ribs C2 and the stretchers C3 can be respectively and pivotally connected to the two sets of pivot connection grooves D21 of the lower nest D2. When mounting the rib set C in the nest set D, the sub ribs C2 and the stretchers C3 must be respectively pivotally connected to the two sets of pivot connection grooves D21 of the lower nest D2, complicating the installation.

SUMMARY OF THE INVENTION

The present invention has been accomplished under the circumstances in view. It is therefore the main object of the present invention to provide an umbrella frame structure for two-fold inverted umbrella, which uses the positioning grooves of the umbrella shaft assembly for receiving the sub ribs and stretchers of the respective rib assemblies, facilitating installation of the rib assemblies in the umbrella shaft assembly.

It is another object of the present invention to provide an umbrella frame structure for two-fold inverted umbrella, which has the flat connection portions of the connectors of the sub ribs of the rib assemblies be set in between the opposite side walls of the respective stretchers to minimize the overall dimension for easy storage when the rib assemblies are collapsed.

To achieve these and other objects of the present invention, an umbrella frame structure for two-fold inverted umbrella comprises an umbrella shaft assembly and a plurality of rib assemblies. The umbrella shaft assembly comprises an umbrella shaft, a handle connected to one end of the umbrella shaft, an upper nest connected to an opposite end of the umbrella shaft, and a lower nest sleeved onto the umbrella shaft and axially movable back and forth relative to the upper nest. The lower nest comprises a plurality of positioning grooves equiangularly spaced around the periphery thereof, a plurality of locating grooves equiangularly and transversely spaced around the periphery thereof and respectively disposed in communication between each two adjacent positioning grooves, and a pivot positioning member located in each locating groove. Each rib assembly comprises a main rib, a sub rib, a stretcher and a tip. The tip connects one end of the main rib and one end of the sub rib.

The stretcher has one end thereof connected to a part of the main rib between two opposite ends of the main rib, and an opposite end thereof disposed in one respective positioning groove. The main rib has an opposite end thereof pivotally connected to the upper nest of the umbrella shaft assembly. The sub rib has an opposite end thereof disposed in one respective positioning groove. The end of the sub rib and the end of the stretcher that are disposed in one respective positioning groove are pivotally connected together by the respective pivot positioning member.

Other advantages and features of the present invention will be fully understood by reference to the following specification in conjunction with the accompanying drawings.

DETAILED DESCRIPTION OF THE PREFERRED EMBODIMENT

Figure 1:
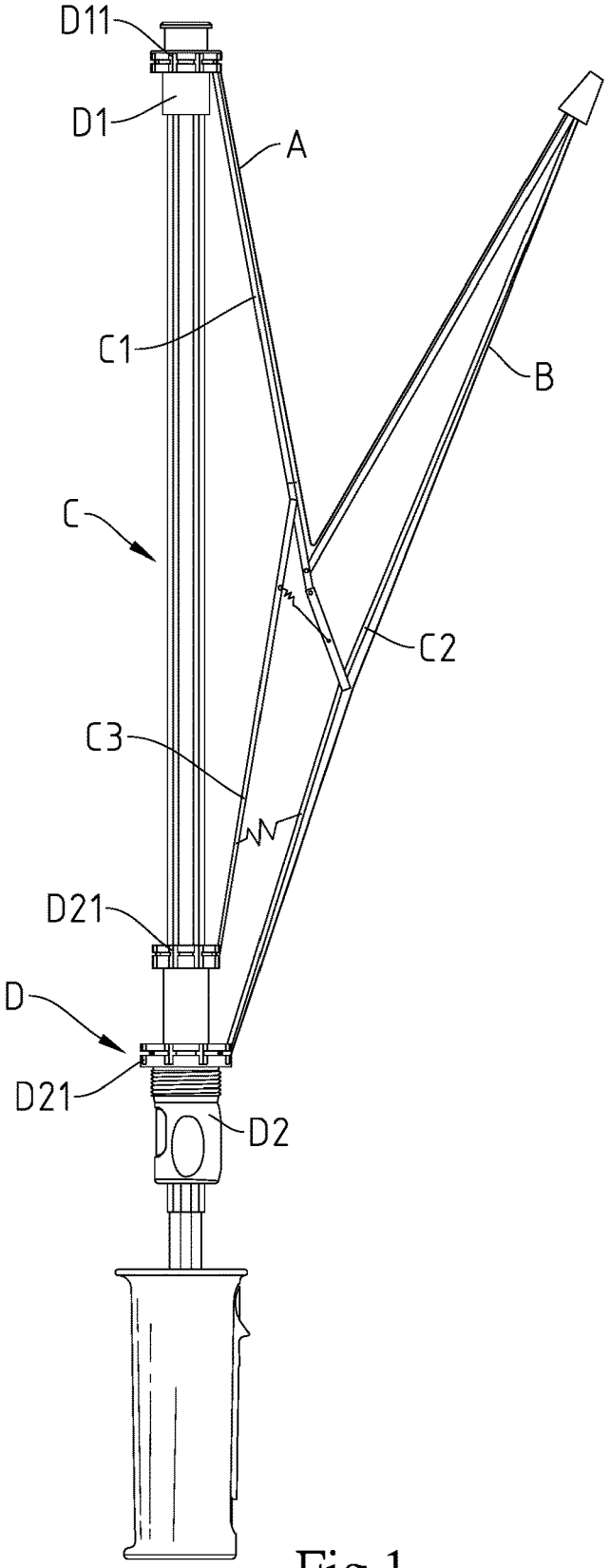
Fig.1 Prior Art
FIG. 1 is an elevational view of an umbrella frame structure for two-fold inverted umbrella according to the prior art.
Figure 2:
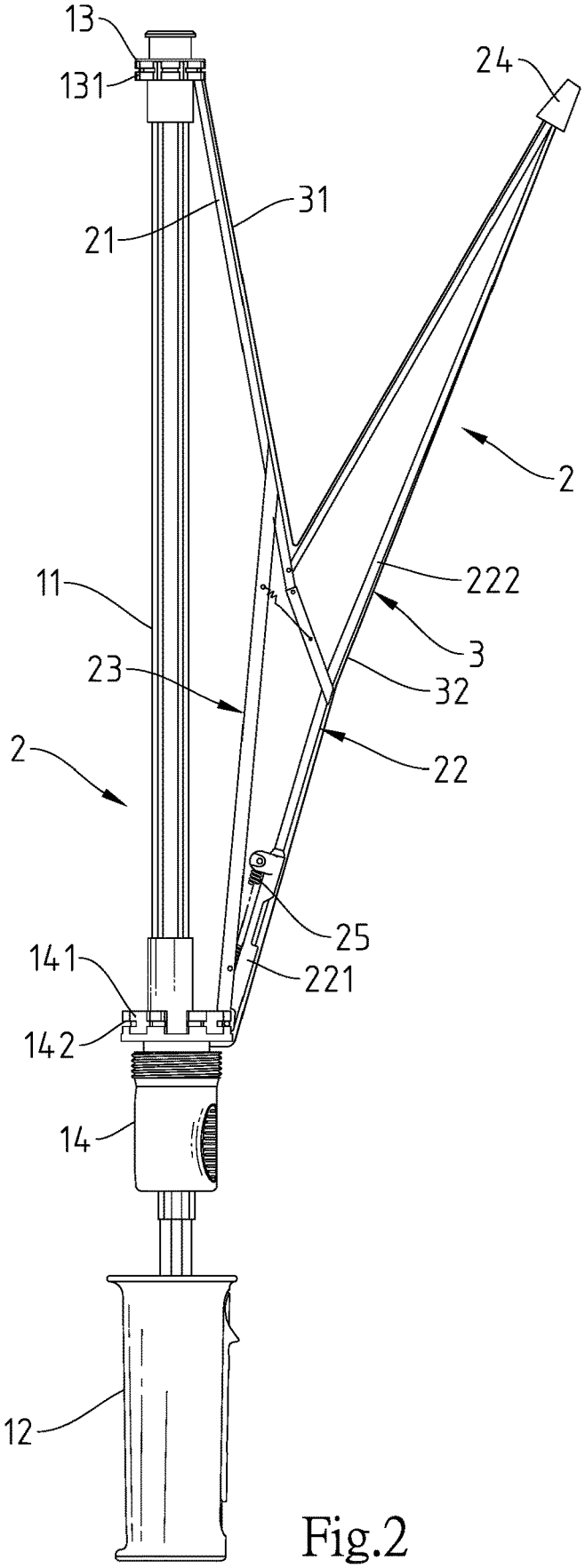
FIG. 2 is an elevational view of an umbrella frame structure for two-fold inverted umbrella in accordance with the present invention.
Figure 3:
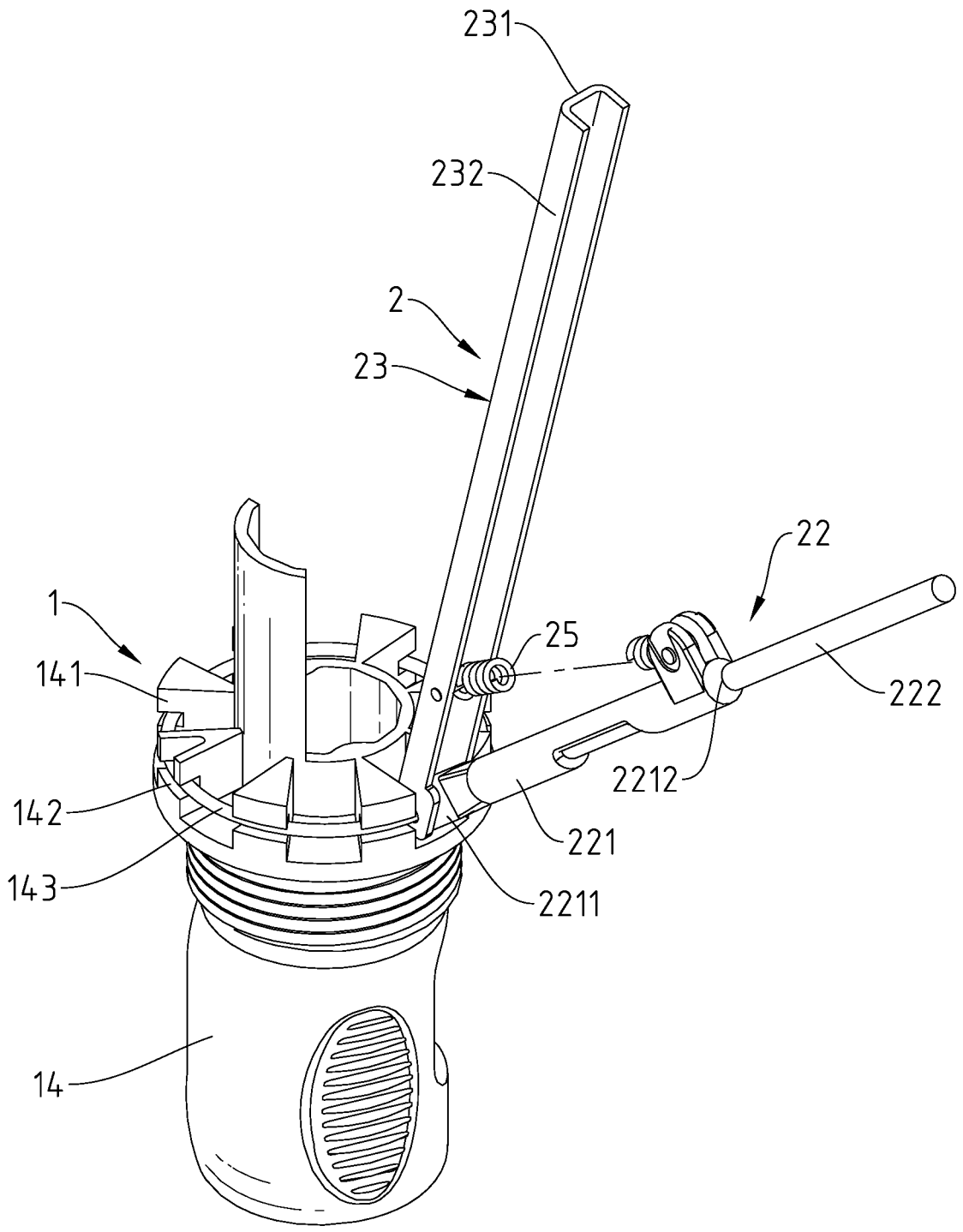
FIG. 3 is an elevational view of a part of the umbrella frame structure of the present invention.
Figure 4:
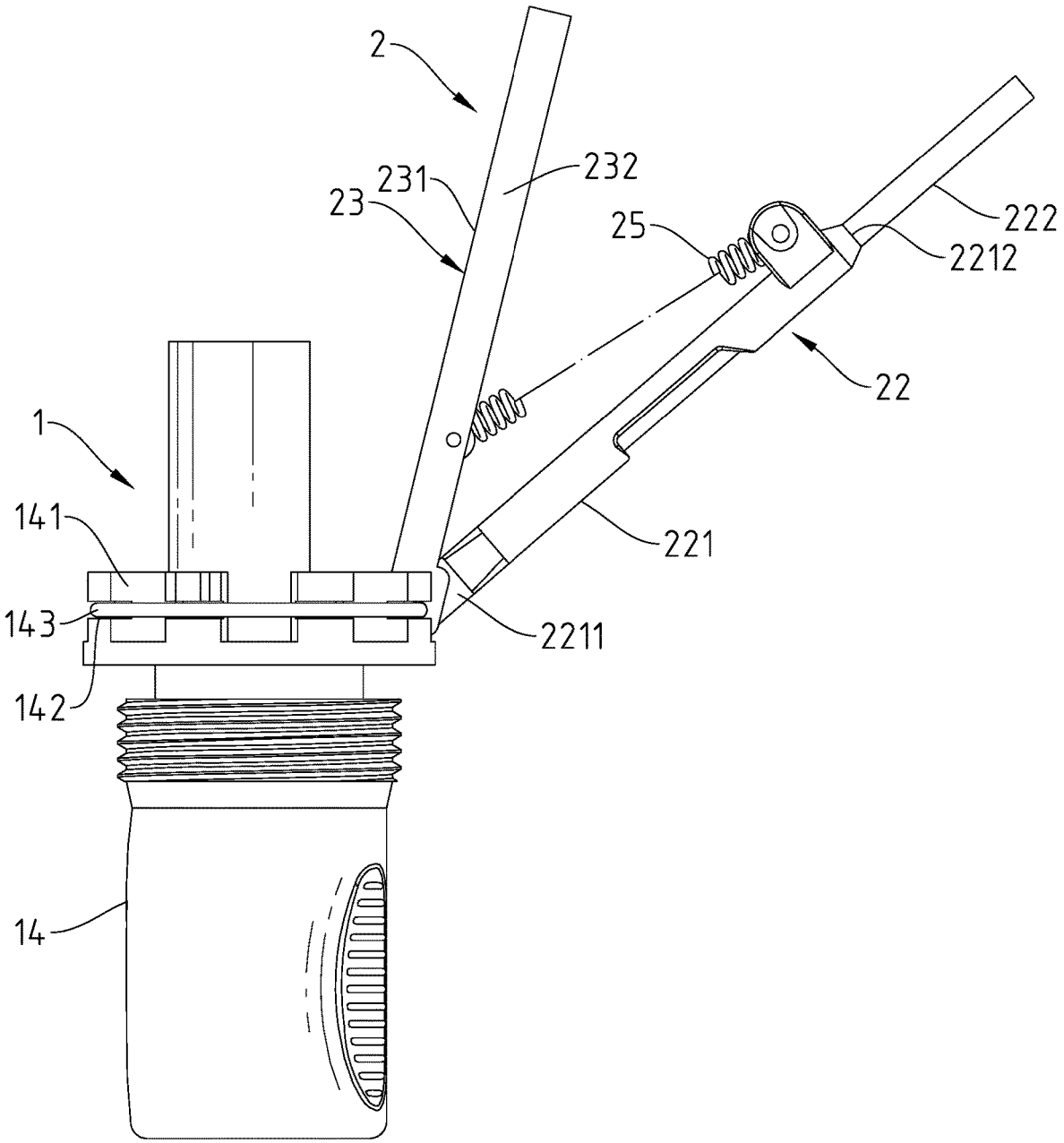
FIG. 4 is a side view of FIG. 3.
Figure 5:
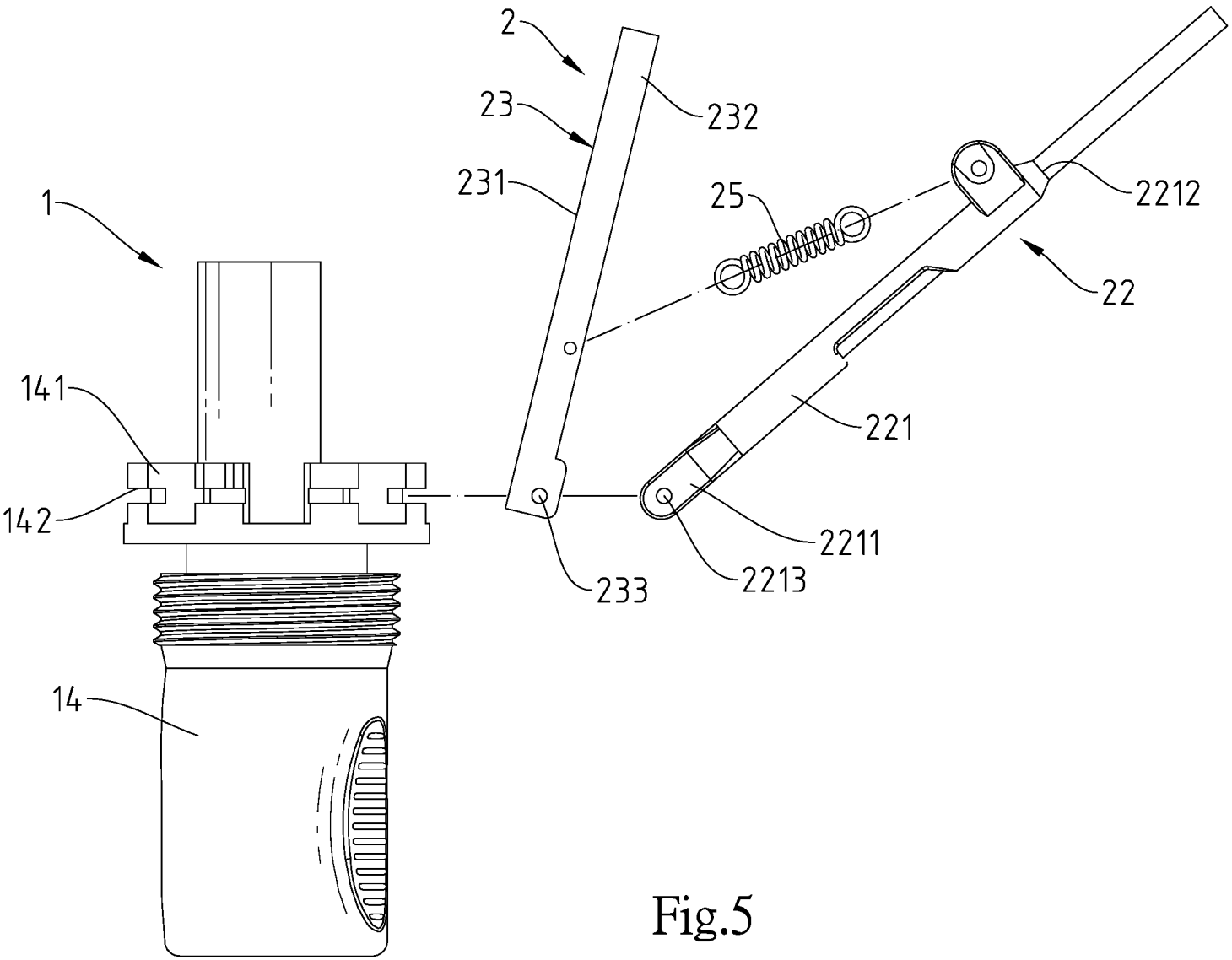
FIG. 5 is an exploded view of a part of the umbrella frame structure of the present invention.
Figure 6:
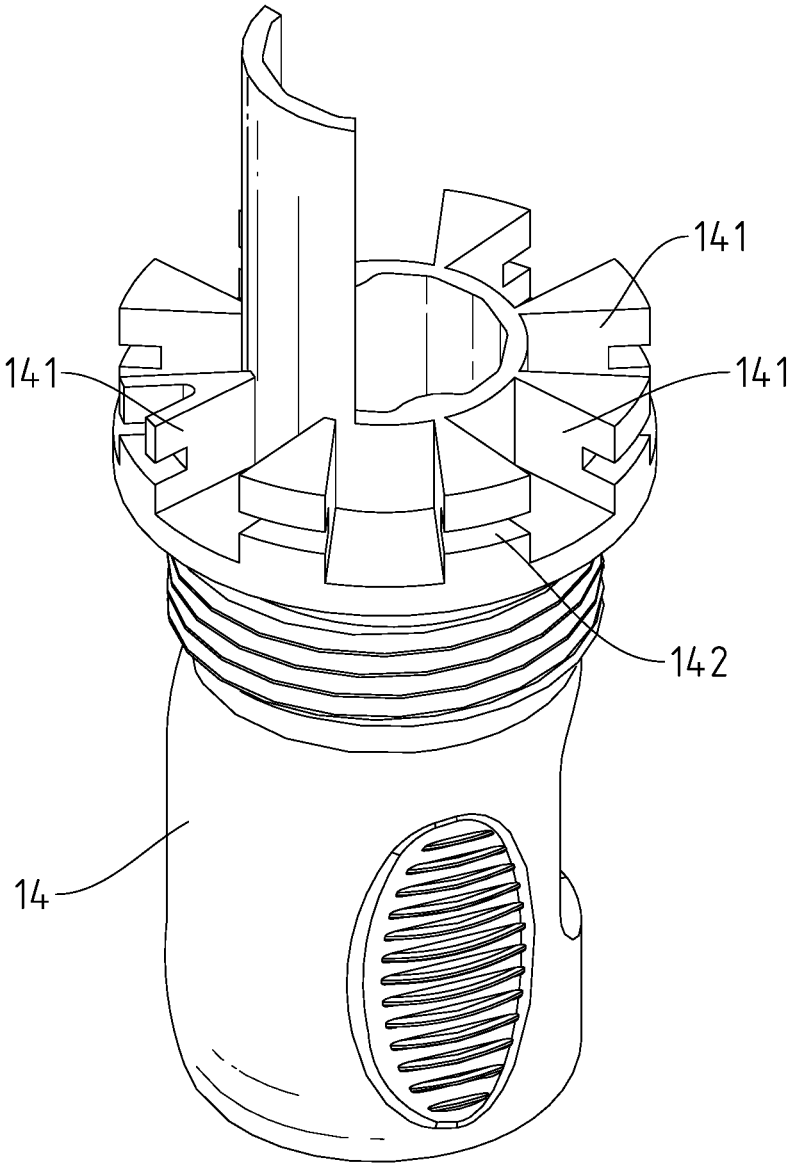
FIG. 6 is an oblique top view of a part of the present invention, illustrating the structure of the lower nest.

Referring to FIGS. 2-6, an umbrella frame structure for two-fold inverted umbrella in accordance with the present invention is shown. The two-fold inverted umbrella comprises an umbrella frame structure consisting of an umbrella shaft assembly 1, a plurality of rib assemblies 2, and an umbrella cloth 3.

The umbrella shaft assembly 1 comprises an umbrella shaft 11, a handle 12, an upper nest 13 and a lower nest 14. The upper nest 13 and the handle 12 are respectively fixedly connected to opposing top and bottom ends of the umbrella shaft 11. The lower nest 14 is sleeved onto the umbrella shaft 11 and axially movable back and forth relative to the upper nest 13. The upper nest 13 has a plurality of locating grooves 131 equiangularly spaced around the periphery thereof. The lower nest 14 has a plurality of positioning grooves 141 equiangularly spaced around the periphery thereof, a plurality of locating grooves 142 equiangularly and transversely spaced around the periphery thereof and respectively disposed in communication between each two adjacent positioning grooves 141, and a pivot positioning member 143 located in each locating groove 142.

The rib assemblies 2 each comprise a main rib 21, a sub rib 22, a stretcher 23, a tip 24 connecting a distal end of the main rib 21 and a distal end of the sub rib 22, and a spring 25 connected between the sub rib 22 and the stretcher 23. The stretcher 23 has one end thereof connected to a part of the main rib 21 between its two opposite ends, and an opposite end thereof disposed in one respective positioning groove 141 of the lower nest 14. The main rib 21 has an opposing proximity end thereof pivotally connected to the upper nest 13 of the umbrella shaft assembly 1. The sub rib 22 has an opposing proximity end thereof pivotally connected to one respective positioning groove 141 of the lower nest 14. The sub rib 22 comprises a connector 221 and a sub rib body 222. The connector 221 has a flat connection portion 2211 located at one end thereof, and a positioning through hole 2212 located at an opposite end thereof. The sub rib body 222 has one end thereof mounted in the positioning through hole 2212, an opposite end thereof connected to the main rib 21 by the tip 24. The stretcher 23 is shaped like a channel bar comprising an elongated base wall 231, and two opposing side walls 232 longitudinally disposed at two opposite lateral sides of the base wall 231. The flat connection portion 2211 of the connector 221 is disposed between the two opposite side walls 232 of the stretcher 23 and provided with a first pivot hole 2213. The stretcher 23 further comprises a second pivot hole 233 cut through one end of each of the two side walls 232. The first pivot hole 2213 and the second pivot hole 233 are kept in axial alignment. The pivot positioning member 143 is inserted through the first pivot hole 2213 and the second pivot hole 233 to pivotally connect the flat connection portion 2211 and the stretcher 23 to one respective positioning groove 141.

The umbrella cloth 3 includes an outer cloth 31 and an inner cloth 32. The outer cloth 31 is fastened to the main ribs 21 of the rib assembly 2. The inner cloth 32 is fastened to the sub ribs 22.

Thus, when using the pivot positioning members 143 to pivotally connect the sub ribs 22 and the respective stretcher 23, the sub ribs 22 and the stretchers 23 are respectively set in the respective positioning grooves 141. In addition to reducing assembly processes, it is easy to assemble. Receiving the flat connection portion 2211 of each sub rib 22 in between the two opposite side walls 232 of the respective stretcher 23 facilitates alignment between the first pivot hole 2213 and the second pivot hole 233 for the connection of the respective pivot positioning member 143 and minimizes the overall dimension for easy storage when the rib assemblies 2 are collapsed.

What is claimed is:

1. An umbrella frame structure for a two-fold inverted umbrella, comprising:

an umbrella shaft assembly comprising an umbrella shaft, a handle connected to one end of said umbrella shaft, an upper nest connected to an opposite end of said umbrella shaft and a lower nest sleeved onto said umbrella shaft and axially movable back and forth relative to said upper nest, said lower nest comprising a plurality of positioning grooves equiangularly spaced around the periphery thereof, a plurality of locating grooves equiangularly and transversely spaced around the periphery thereof and respectively disposed in communication between each two adjacent said positioning grooves and a pivot positioning member located in each said locating groove; and a plurality of rib assemblies, each said rib assembly comprising a main rib, a sub rib, a stretcher and a tip, said tip connecting one end of said main rib and one end of said sub rib, said stretcher having one end thereof connected to a part of said main rib between two opposite ends of said main rib and an opposite end thereof disposed in one respective said positioning groove, said main rib having an opposite end thereof pivotally connected to said upper nest of said umbrella shaft assembly, said sub rib having an opposite end thereof disposed in one respective said positioning groove, the end of said sub rib and the end of said stretcher that are disposed in one respective said positioning groove being pivotally connected together by the respective said pivot positioning member;

wherein said sub rib comprises a connector and a sub rib body, said connector comprising a flat connection portion located at one end thereof and a positioning through hole located at an opposite end thereof, said sub rib body having one end thereof positioned in said positioning through hole of said connector and an opposite end thereof connected to the said main rib of one respective said rib assembly by one respective said tip;

said stretcher comprises an elongated base wall and two opposite side walls respectively extended from two opposite lateral sides of said elongated base wall; and said flat connection portion of said connector is disposed between the said two opposite side walls of one respective said stretcher and pivotally connected to one end of one respective said stretcher in one respective said positioning groove by one respective said pivot positioning member.

2. The umbrella frame structure as claimed in claim 1, wherein said connector further comprises a first pivot hole located on said flat connection portion; said stretcher further comprises a second pivot hole cut through one end of each of the said opposite side walls thereof and pivotally connected with said first pivot hole of said connector of the respective said sub rib in one respective said positioning groove by one respective said pivot positioning member.

3. The umbrella frame structure as claimed in claim 1, wherein each said rib assembly further comprises a spring connected between said sub rib and said stretcher.

* * * * *